United States Patent [19]

Lew

[11] Patent Number: 4,921,399

[45] Date of Patent: May 1, 1990

[54] GAS PIPELINE TEMPERATURE CONTROL

[75] Inventor: Lawrence E. Lew, Bartlesville, Okla.

[73] Assignee: Phillips Petroleum Company, Bartlesville, Okla.

[21] Appl. No.: 305,687

[22] Filed: Feb. 3, 1989

[51] Int. Cl.[5] ..... F04D 29/02

[52] U.S. Cl. ..... 415/27; 415/1; 415/28; 415/47

[58] Field of Search ..... 415/1, 17, 11, 26, 27, 415/28, 58.4, 47, 144, 145, 175, 176, 177, 179, 52.1, 57.1

[56] References Cited

U.S. PATENT DOCUMENTS

| | | | |
|---|---|---|---|
| 2,619,453 | 11/1952 | Anderson | 203/10 |
| 2,925,784 | 2/1960 | Jennings | 415/28 |
| 3,276,674 | 10/1966 | Hens | 415/28 |
| 3,292,845 | 12/1966 | Hens et al. | 415/11 |
| 4,156,578 | 5/1979 | Agar et al. | 415/1 |
| 4,230,437 | 10/1980 | Bellinger et al. | 415/1 |
| 4,372,332 | 2/1983 | Mast | 137/1 |
| 4,452,048 | 6/1984 | Geary, Jr. et al. | 415/11 |
| 4,744,723 | 5/1988 | Hashimoto et al. | 415/145 |
| 4,807,150 | 2/1989 | Hobbs | 415/11 |

FOREIGN PATENT DOCUMENTS

| | | | |
|---|---|---|---|
| 143009 | 12/1978 | Japan | 415/11 |
| 143010 | 12/1978 | Japan | 415/11 |
| 817321 | 3/1981 | U.S.S.R. | 415/58.4 |

*Primary Examiner*—Robert E. Garrett
*Assistant Examiner*—John T. Kwon
*Attorney, Agent, or Firm*—George E. Bogatie

[57] ABSTRACT

In a compressor station for boosting the pressure of gas stream being transported in a pipeline wherein the act of recompressing the gas stream to a desired pressure results in a gas temperature sufficiently high to stimulate cracking activity in the pipeline when the compressed stream gas is reinjected into the pipeline, method and apparatus are disclosed for cooling a portion of the warm compressed gas to form a cool gas stream and then controlling a division of the cooled stream to supply both a cooled recycle stream for anti-surge control and a cooled stream for mixing with the warm compressed gas for temperature control.

13 Claims, 2 Drawing Sheets

GAS PIPELINE TEMPERATURE CONTROL

Figure 1:
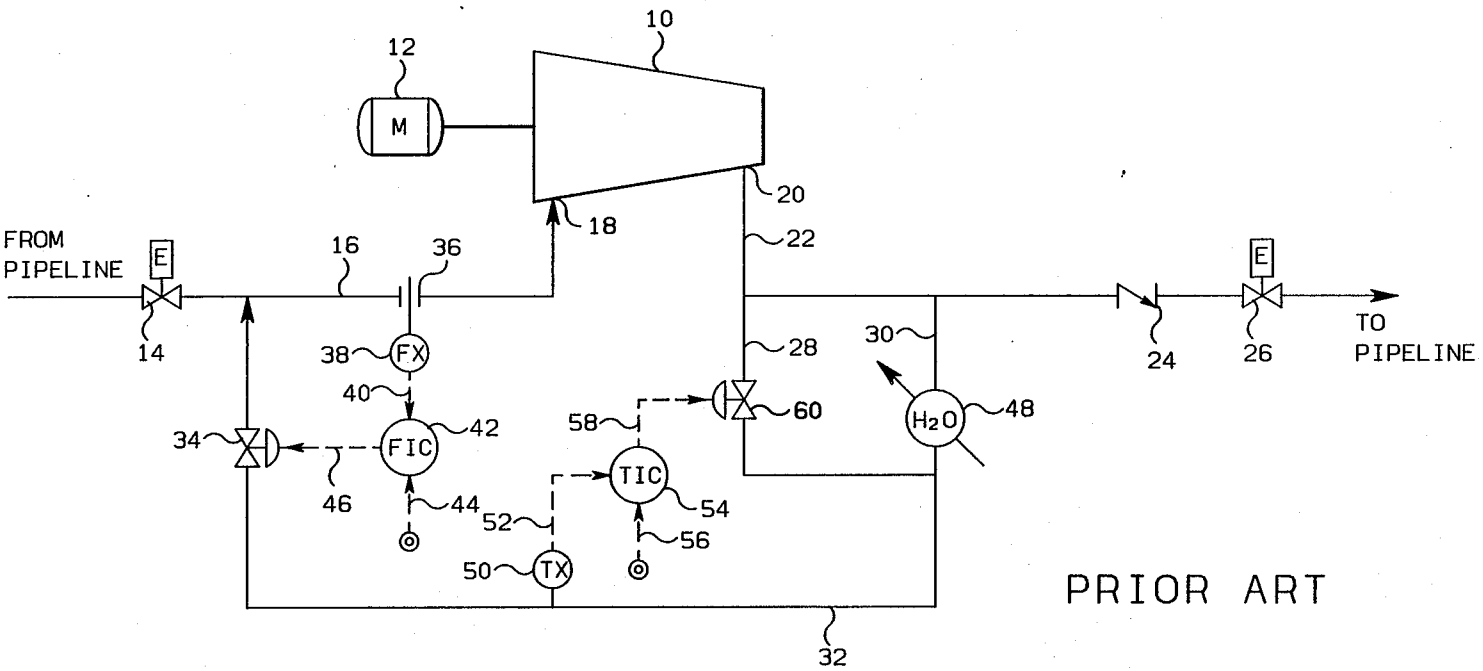

This invention relates to gas pipeline pressure booster stations which are constructed offshore or constructed onshore in cold regions. In one aspect it relates to apparatus for manipulating the gas flow rate through a cooler associated with a pipeline. In another aspect it relates to a method for reducing the temperature of gas discharged into the pipeline from the booster station so as to prevent thermal stress from encouraging cracking in the pipeline.

BACKGROUND OF THE INVENTION

Pipeline booster stations are used in long gas pipelines to maintain a desired discharge pressure, suction pressure, and/or flow rate of the gas in a pipeline. Generally a pipeline booster station receives a cool decompressed gas stream and employs centrifugal compressors to produce high volume flow with relatively low ratio of discharge to suction pressure. Since these booster stations are typically unattended offshore platforms or located in remote land areas, automatic shutdown systems are typically employed which operate to shutdown the station if an abnormal operating condition is detected.

One can manipulate the outlet flow of a centrifugal compressor by suction throttling, discharge throttling, variable inlet guide veins or variable speed such that a desired outlet flow can be maintained. However, the centrifugal compressor control system is not complete without consideration of surge control. A typical example of surge control involves cooling a portion of the compressed gas in a recycle cooler for recycle to the compressor's suction inlet. In this type of surge control a desired minimum temperature for the recycle gas and a desired minimum suction flow rate for the compressor are maintained to insure operation of the compressor that is safe from surge.

In operation of a typical pipeline pressure booster station, cold decompressed gas, e.g. 800 psi and 27° F., flowing into the booster station is raised in pressure to a desired pressure of about 2,000 psi by one or more compressors. Unfortunately, however, the act of compressing the gas to raise the pressure to a desired value also raises the temperature of the gas to an undesirable value, such that discharging the compressed gas from the compressor outlet directly into the pipeline at an elevated temperature could aid other factors, such as corrosion, in causing cracking in the pipeline. Therefore, the compressed gas at the compressor outlet should not be reinjected into the pipeline until its temperature is reduced if the possibility of avoiding cracks in the pipeline is to be maximized.

As in any commercial process, it is desirable that the cooling process be carried out while minimizing the equipment required for carrying out the cooling process. This is especially true in pipeline pressure booster stations since the stations are typically located offshore or in remote land areas where sheltered areas and commercial electric power are at a premium.

It is thus noted that the recycle stream and the recycle cooler utilized for surge control of the compressor are typically sized to handle about 70 percent of the compressor capacity. However, in normal operation of the pipeline, the compressor generally carries more than 70% of its rated capacity and therefore the recycle cooling capacity is not needed for surge control. The maximum cooling capacity of the recycle cooler could only be required during startup or testing of the compressor, and during these operations temperature reduction requirements for the gas discharged from the booster station into the pipeline are minimal due to the low suction inlet flow, and correspondingly low compressor discharge flow.

It is thus an object of this invention to provide apparatus and method for reducing the temperature of a relatively warm compressed gas stream before the gas is discharged into a relatively cool pipeline by using excess cooling capacity of the compressor's recycle cooler to cool the gas before discharging the compressed gas into the pipeline.

It is another object of this invention to cool a portion of the main compressed gas stream and to recombine the cool gas stream with the main compressed gas stream so as to reduce the temperature of the compressed gas discharged from the booster station such that gas is reinjected into the pipeline at a desirable temperature.

It is a still further object of this invention to control the temperature of the gas discharge into the pipeline without interfering with the compressors surge control scheme.

SUMMARY OF THE INVENTION

In accordance with the present invention method and apparatus are provided for reducing the temperature of the discharge stream from a pipeline pressure booster station by cooling a portion of the main compressed gas stream to form a cool gas stream and then recombining a controlled portion of the cool gas stream with the main compressed gas stream. The portion of the cool gas stream is preferably recombined with the main compressed gas stream under temperature control to form the station discharge stream.

In a preferred embodiment, a control signal to manipulate flow rate of the cool gas stream is selected from among three signals which are representative of (1) temperature of the station discharge stream, (2) the pressure drop across the compressor and (3) pressure drop across the recycle cooler. First the higher one of the signals representative of the pressure differential across the recycle cooler and the temperature of the discharge stream is selected. Next the lower one of the signal selected above, and the pressure differential across the compressor is selected to manipulate a control valve in the main compressed gas stream. In this manner, under normal operation, the signal representative of the temperature of the station discharge stream will be selected to manipulate the main compressed gas stream flow, however, if the recycle flow required by the surge system causes a pressure drop across the recycle cooler to exceed a predetermined value, the control of the main compressed gas stream responsive to temperature would be overridden by the differential pressure controller so that the temperature control of the main compressed gas stream would not interfere with the surge control action.

Figure 2:
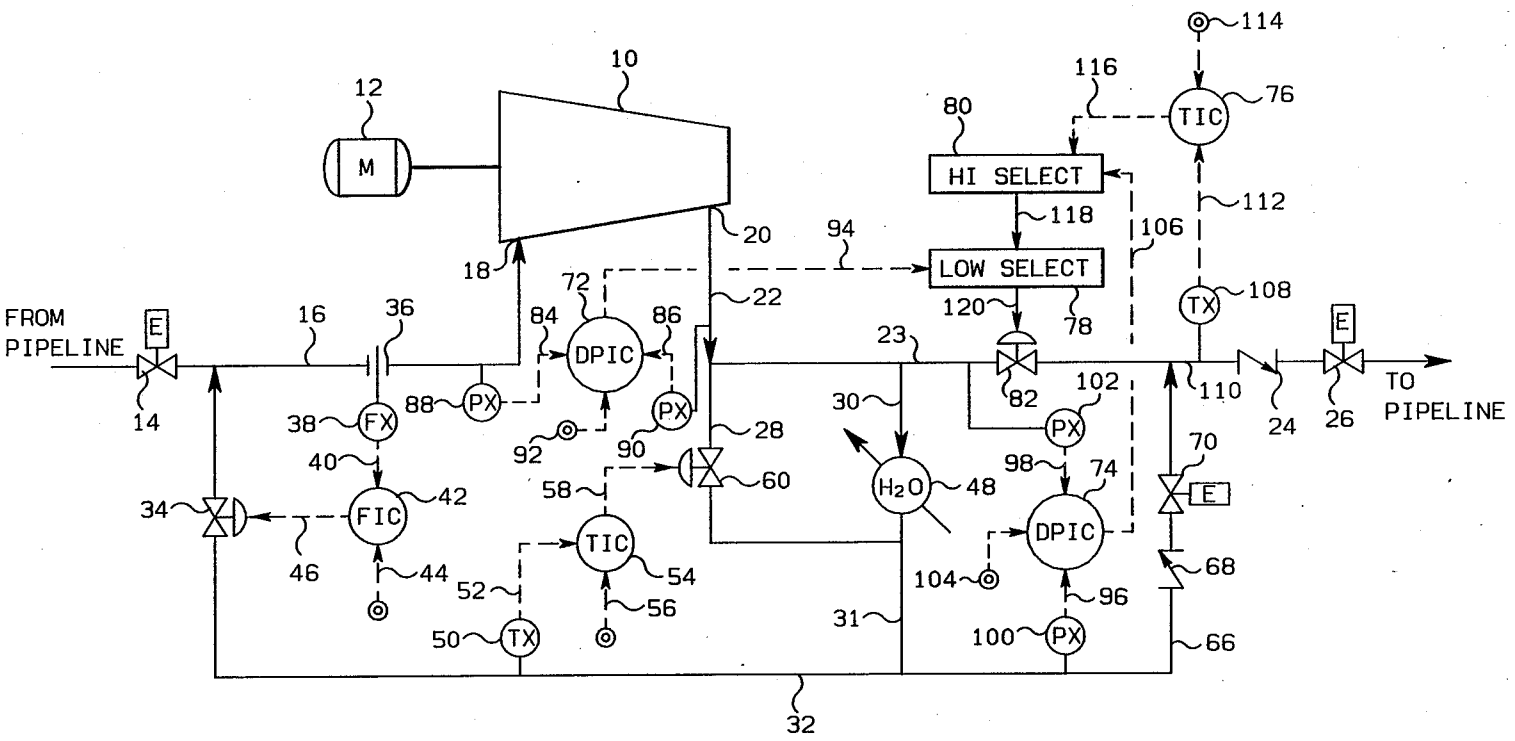

Additional objects and advantages of the invention will be apparent from the following detailed description of the preferred embodiment of the invention as illustrated by the drawings in which:

FIG. 1 is a diagrammatic illustration of a centrifugal compressor with minimal flow type anti-surge control; and FIG. 2 is a diagrammatic illustration of a centrifugal compressor with the associated control system of the present invention.

The invention is illustrated and described in terms of a centrifugal compressor having a particular recycle flow configuration for surge control and a specific discharge flow control system configuration as set forth in FIG. 2 for the sake of illustration; however, the invention extends to different types of control system configurations which accomplish the purpose of the invention.

Lines designated as signal lines in the drawings are electrical or pneumatic in this preferred embodiment. Generally, the signals provided from any transducer are electrical in form; however, the signals provided from flow sensors and the signals provided to control valves will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer.

The invention is also applicable to mechanical, hydraulic or other signal means for transmitting information. In almost all control systems some combination of electrical, pneumatic, mechanical or hydraulic signals will be used; however, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate are compared by a controller. The output could be a signal representative of a desired change in the flow rate of such gas necessary to make the desired and actual flows equal. On the other hand the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

Likewise selective control is well known in the control system art. Signal selectors choose either the lowest, medium or highest control signal from among two or more signals.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one of more such equipment types. While the presently preferred embodiment of the invention preferably utilizes a combination of pneumatic final control elements in conjuction with electrical analog signal handling and translation apparatus, the apparatus and method of the invention can be implemented using a variety of specific equipment available to and understood by those skilled in the process control art. Likewise, the format of the various signals can be modified substantially in order to accommodate the signal format requirement of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measurements instruments might product a signal which is proportional to the measured parameter, and still other transducing means may product a signal which bears a more complicated, but known, relationship to the measured parameter. In addition, all signals could be translated into a "suppressed zero" or other similar format to provide a "live zero" and prevent an equipment failure from being interpreted as a low (or high) measurement or control signal. Regardless of the signal format or the exact relationship of the signal of the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawings and in particular to FIG. 1, there is illustrated a prior art scheme for surge control of a centrifugal compressor 10, powered by a suitable motor 12, to which a decompressed gas stream, which is to be compressed, is supplied through shutdown valve 14 in conduit 16 to the compressor inlet 18. For use in a pipeline booster station the motor 12 would typically be a variable speed electric motor. Compressed gas, such as natural gas, is provided from the outlet 20 of compressor 10 through conduit 22 in which check valve 24 and shutdown valve 26 are operably located. Shutdown valves 14 and 26, which are operated by an automatic shutdown system (non illustrated), would typically be remotely operated electric valves which could completely block flow of gas in conduit means 16 and 22 respectively. The compressed gas is delivered at an increased pressure to a pipeline, not shown.

Compressed gas is recycled from the outlet 20 of compressor 10 to suction inlet 18 of compressor 10 through the combination of conduits 22, 28, 30, 32 and 16 by opening control valve 34 which is operably located in conduit 32. The recirculation of gas from the outlet 20 of compressor 10 to the suction inlet 18 is controlled by utilizing the combination of flow sensor 36 and flow transducer 38 to provide an output signal 40 which is representative of the flow rate of gas flowing through conduit 16. Signal 40 is provided as an input signal to flow controller 42. Flow controller 42 is also provided with a set point signal 44 which is representative of the desired flow rate of the gas flowing through conduit 16. In response to signals 40 and 44, flow controller 42 provides an output signal 46 which is responsive to the difference between signals 40 and 44. Control valve 34 is manipulated in response to signal 46 to thereby maintain the actual flow of gas through conduit 16 substantially equal to the flow rate represented by set point signal 44. Set point signal 44 is typically set close to the normal 100 percent operating point on the constant speed curve for the compressor 10 to avoid possible damage to the compressor that would result from the compressor 10 passing into the surge region indicated on the family of constant speed operating curves. For example, set point signal 44 may be set at 70 percent of the capacity for the actual constant speed curve on which the compressor 10 is operating. Temperature of the recirculating gas from the outlet 20 to the compressor suction inlet 18 is reduced as low as possible to reduce the pressure drop through the recycle system and also to minimize the volume of gas required to be cooled. For example, in an actual pressure booster station where the design temperature for the compressor inlet gas is about 27° F., the recycle gas is cooled to a minimum temperature of about 80° F. because further cooling presented the possibility of condensing liquids as the recycle gas flashed across the control valve 34, and the condensing of liquids across valve 34 would damage the compressor 10.

The recycle gas is cooled in water cooler 48 which is operably located in a conduit 30 and the temperature of the recycle gas is controlled by utilizing the temperature transducer 50 which, in combination with a temperature measuring device such as a thermocouple, provides temperature signal 52 which is representative of the temperature of the gas flowing in conduit 32. Signal 52 is provided to temperature controller 54. Temperature controller 54 is also provided with a set point signal 56 which is representative of the desired temperature of the gas flowing through conduit 32. In response to signals 52 and 56, temperature controller 54 provides an output signal 58 which is responsive to the difference between signals 52 and 54. Control valve 60 is manipulated in response to signal 58 to thereby maintain the temperature of the gas flowing in conduit 32 substantially equal to the temperature represented by set point signal 56.

In accordance with the present invention, method and apparatus are provided whereby the water cooler 48, illustrated in FIG. 1, which is utilized to cool the compressed recycle gas flowing in conduit 32, is also utilized to cool the compressed gas stream flowing in conduit 110. Temperature reduction of the discharge stream flowing in conduit 110 is generally accomplished by mixing gas, which has been cooled in the water cooler 48, back into conduit 110 under temperature control.

Referring now to FIG. 2, where like reference numerals are used in FIG. 1 and FIG. 2 for parts which appear in both drawing figures, there is illustrated a preferred embodiment of the present invention. In reference to FIG. 2 only parts which are not illustrated in FIG. 1 will be fully discussed hereinafter.

A portion of the gas cooled in the water cooler 48 is supplied as a mixing stream in conduit 66 which is recombined with the main compressed gas stream flowing in conduit 23 to form the discharge stream flowing in conduit 110.

Differential pressure controllers 72 and 74, temperature controller 76 and control valve 82, which operate in selective control loops in conjunction with a low select 78 and a high select 80, have been added to the prior art control system illustrated in FIG. 1. The differential pressure controller 72 receives measurement input signals 84 and 86 from pressure transducers 88 and 90, respectively, which are operatively connected to conduits 16 and 22, respectively. Differential pressure controller 72 also receives a set point signal 92 which is representative of the desired minimum pressure drop across compressor 10. In response to signals 92, 84 and 86, differential pressure controller 72 provides an output signal 94 which is responsive to signals 92, 84 and 86. Signal 94 is provided from a differential pressure controller 72 as a first input signal to low select block 78.

In a like manner differential pressure controller 74 receives measurement input signals 96 and 98 from pressure transducers 100 and 102, respectively, which signals are representative of the actual pressure in conduits 66 and 22, respectively. Differential pressure controller 74 also receives a set point signal 104 which is representative of the desired pressure drop across water cooler 48. In response to signals 96, 98 and 104, differential pressure controller 74 provides an output control signal 106 which is responsive to signals 96, 98 and 104. Signal 106 is provided as a first input to high select block 80.

Temperature transducer 108 in combination with a temperature measuring device such as a thermocouple which is operatively connected to conduit 110 provides an output signal 112, which is representative of the actual temperature of a gas flowing in conduit 110. Temperature measurement output signal 112 is provided as an input to temperature controller 76. Temperature controller 76 is also provided with a set point signal 114 which is representative of the desired temperature of the gas flowing in conduit 110. In response to signals 112 and 114 temperature controller 76 provides an output control signal 116 which is responsive to the difference between signals 112 and 114. Signal 116 is provided as a second input to high select block 80.

The one of control signals 106 and 116 which has the greater magnitude is output from high select 80 as signal 118. Thus signal 118 would have a magnitude equal to the magnitude of either signal 106 or 116, whichever is the higher. Signal 118 is provided from high select block 80 as a second input to low select block 78. In a similar manner the one of controller signals 118 and 94 which has the lesser magnitude is output from low select block 78 as signal 120. Thus signal 120 would have a magnitude equal to control signal 94, 106 or 116, depending on the relative magnitude of the signals which are provided as inputs to the select blocks 78 and 80.

Control signal 120 is provided from low select block 78 to control valve 82, and control valve 82 is manipulated in response to the signal 120 to thereby maintain the position of control valve 82 such that the set point signal associated with the control signal selected as signal 120, i.e. the temperature represented by signal 114 or differential pressure represented by signal 104 or 92, is maintained as the actual value of the corresponding measured parameter.

As an example of the operation of the selective control loop illustrated in FIG. 2, assume under normal operating conditions that control signal 116 is selected as signal 120 to manipulate valve 82 so as to maintain the actual temperature in conduit 110 substantially equal to the desired temperature represented by signal 114. Further assume that the set point for differential pressure controller 74 is set at a limiting value which is above the normal pressure differential across water cooler 48, and that the set point for differential pressure controller 72 is set at a limiting value which is below the normal pressure drop across compressor 10. If then for some reason the differential pressure across the water cooler 48 would increase to approach the set point value represented by signal 104, the output of controller 74 increases, since controller 74 is a reverse acting controller, such that signal 106 will decrease and will eventually be selected as signal 120 to manipulate control valve 82, and controller 74 will seek to maintain the actual differential pressure across the water cooler 48 substantially equal to the limiting differential pressure represented by signal 104 by manipulating control valve 82 in response to signal 106. In this manner the normal temperature control provided by controller 76 is overridden by differential pressure controller 74 in the event of an abnormal pressure drop across water cooler 48.

In a similar manner, low select block 78 would select signal 94 as signal 120 if the the differential pressure across the compressor 10 decreases to approach the set point value represented by signal 92 or is below the set point value, e.g. on start up. In this manner both the temperature control and the differential pressure control responsive to the pressure differential across water cooler 48 are overridden to guard against exceeding constraints of the compressor 10.

The invention has been described in terms of a presently preferred embodiment as illustrated in FIG. 2. Specific components which can be used in the practice of the invention as illustrated in FIG. 2 such as flow transducer 38, pressure transducers 88, 90, 100, and 102, temperature transducer 50, control valves 34, 60 and 82, flow controller 42, temperature controllers 54 and 76, pressure controllers 72 and 74, and selectors 78 and 80 are each well known commercially available control components such as are described at length in Perry's Chemical Engineer's Handbook, 6th Edition, Chapter 22, McGraw-Hill.

While the invention has been described in terms of the presently preferred embodiment, reasonable modifications and variations are possible by those skilled in the art and such modifications and variations are within the scope of the described invention and the appended claims.

That which is claimed is:

1. Apparatus comprising:

compressor means (10), having an inlet (18) and an outlet (20), for compressing gas from a pipeline;

first conduit means (16), connected to said inlet (18), for providing an inlet stream to said compressor means (10);

second conduit means (22), connected to said outlet (20), for removing compressed gas from said compressor means (10) in a compressed gas stream flowing in said second conduit means (22);

third conduit means (23, 28, 30), comprising a first branch (28, 30) and a second branch (23) connected to said second conduit means (22), for causing a division of said compressed gas stream flowing in said second conduit means (22) into a sidestream and a main stream, wherein said sidestream flows in said first branch (28, 30) and said mainstream flows in said second branch (23);

cooling means (48, 60), operatively connected in said first branch (28, 30), for receiving said sidestream and for passing chilled compressed gas to a fourth conduit means (31) so as to form a cool compressed gas stream;

fifth conduit means, comprising a third branch (32) and a fourth branch (66), connected to said fourth conduit means (31), for dividing said cool compressed gas stream flowing in said fourth conduit means (31) so as to form a recycle stream flowing in said third branch (32) and a blending stream flowing in said fourth branch (66);

sixth conduit means, connected to said first conduit means (16), for receiving a decompressed gas stream to be compressed, and for combining said recycle stream flowing in said fourth branch (32) and said decompressed gas stream so as to form said inlet stream flowing in said first conduit means (16);

first flow rate manipulation means (34, 42) for manipulating the flow rate of said recycle stream flowing in said third branch (32) so as to maintain at least a minimum flow rate for said inlet stream flowing in said first conduit means (16), thereby preventing surging in said compressor means (10);

seventh conduit means (110) for combining said blending stream flowing in said fourth branch (66) and said mainstream flowing in said second branch (23) so as to form a discharge stream flowing in said seventh conduit means (110), wherein said discharge stream is supplied to said pipeline; and second flow rate manipulating means (82, 76) for manipulating the division of said compressed gas stream flowing in said second conduit means (22), wherein said first portion flows in conduits (28, 30) and said second portion flows in conduit (23), so as to maintain a desired temperature for said discharge stream flowing in said sixth conduit means (110).

2. Apparatus in accordance with claim 1 wherein said first flow rate manipulating means comprises:

means for establishing a first signal representative of the actual flow rate of said inlet stream;

means for establishing a second signal representative of a desired minimum flow rate for said inlet stream;

means for comparing said first signal and said second signal and for establishing a third signal responsive to the difference between said first signal and said second signal; and means for manipulating the flow rate of said recycle stream in response to said third signal.

3. Apparatus in accordance with claim 2 wherein said first flow, rate manipulating means additionally comprises:

a first control valve, wherein said recycle stream flows through said first control valve; and means for scaling said third signal so as to be representative of the position of said first control valve required to maintain the actual flow rate of said inlet stream represented by said first signal substantially equal to the desired minimum flow rate of said inlet stream represented by said second signal.

4. Apparatus in accordance with claim 3 wherein said cooling means comprises:

a cooler having an inlet for receiving warm compressed gas and an outlet for discharging chilled compressed gas;

bypass conduit means for diverting flow of warm compressed gas around said cooler;

a second control valve operably located in said bypass conduit means;

means for establishing a fourth signal representative of the actual temperature of said recycle stream;

means for establishing a fifth signal representative of a desired minimum temperature for said recycle stream; and means for comparing said fourth signal and said fifth signal and for establishing a sixth signal, which is responsive to the difference between said fourth signal and said fifth signal, and for scaling said sixth signal so as to be representative of the position of said second control valve required to maintain the actual temperature of said recycle stream, represented by said fourth signal, substantially equal to the desired temperature for said recycle stream represented by said fifth signal.

5. Apparatus in accordance with claim 4 wherein said second flow rate manipulating means for manipulting the division of said compressed gas stream so as to maintain a desired temperature for said discharge stream comprises:

a third control valve, operably located in said second branch;

means for establishing a seventh signal representative of the actual temperature of said discharge stream;

means for establishing an eighth signal representative of a desired temperature for said discharge stream;

means for comparing said seventh signal and said eighth signal and for establishing a ninth signal, which is responsive to the difference between said seventh signal and said eighth signal, and for scaling said ninth signal so as to be representative of the position of said third control valve required to maintain the actual temperature of said discharge stream, represented by said seventh signal, substantially equal to the desired temperature represented by said eighth signal; and means for manipulating said third control valve in response to said ninth signal.

6. Apparatus in accordance with claim 1 wherein said means for manipulating the division of said compressed gas stream additionally comprises:

means for establishing a tenth signal representative of the actual differential pressure across said cooler;

means for establishing an eleventh signal representative of a desired maximum differential pressure across said cooler;

means for comparing said tenth signal and said eleventh signal and for establishing a twelfth signal which is responsive to the difference between said tenth signal and said eleventh signal and for scaling said twelfth signal so as to be representative of the position of said third control valve required to maintain the actual differential pressure across said cooler represented by said tenth signal substantially equal to the desired maximum pressure represented by said eleventh signal;

high select means for receiving two input signals and passing therethrough the higher one of said input signals;

means for providing said ninth signal and said twelfth signal as input signals to said high select means wherein said high select means selects the one of said ninth and twelfth signals which represents the greater opening of said third control valve to be established as a thirteenth signal;

means for establishing a fourteenth signal which is representative of the actual differential pressure across said compressor means;

means for establishing a fifteenth signal which is representative of a desired maximum differential pressure across said compressor means;

means for comparing said fourteenth signal and said fifteenth signal and for establishing a sixteenth signal which is responsive to the difference between said fourteenth signal and said fifteenth signal and for scaling said sixteenth signal so as to be representative of the position of said third control valve required to maintain the actual differential pressure across said compressor means represented by said fourteenth signal substantially equal to the desired maximum differential pressure across said compression means represented by said fifteenth signal;

low select means for receiving two input signals and passing therethrough the lower of said input signals;

means for providing said thirteenth signal and said sixteenth signal as inputs to said low select means wherein said low select means selects the one of said thirteenth signal and said sixteenth signal which represents the lesser opening of said third control valve to be established as an seventeenth signal; and means for manipulating said third control valve in response to said seventeenth signal.

7. Apparatus in accordance with claim 6 wherein said means for comparing said tenth signal and said eleventh signal is a reverse acting controller.

8. A method for reducing the temperature of a gas stream that is recompressed in a gas pipeline booster station, wherein a compressor (10) in said booster station includes an inlet (18) for receiving a gas stream to be compressed and an outlet (20) for discharging compressed gas, said method comprising the steps of:

receiving a decompressed gas stream, which has been cooled and decompressed through transportation in a gas pipeline, to form at least a portion of an inlet gas stream to be compressed;

withdrawing compressed gas from said outlet (20) of said compressor (10) to form a compressed gas stream;

causing a division of said compressed gas stream into a sidestream and a mainstream, wherein said division takes place in a branched conduit means comprising a first branch (28, 30), and a second branch (23), and wherein said sidestream flows in said first branch and said mainstream flows in said second branch;

cooling at least a portion of said sidestream so as to form a cool gas stream;

dividing said cool gas stream so as to form a recycle stream and a blending stream;

combining said recycle stream with said decompressed gas stream so as to form said inlet gas stream to be compressed;

manipulating the flow rate of said recycle stream for maintaining at least a minimum flow rate for said inlet gas stream so as to prevent surging in said compressor;

combining said mainstream and said blending stream so as to form a discharge stream;

manipulating the division of said compressed gas stream so as to maintain a desired temperature in said discharge stream; and injecting said discharge stream into said pipeline.

9. A method in accordance with claim 8 wherein said step of manipulating the flow rate of said recycle stream comprises:

establishing a first signal representative of the actual flow rate of said inlet stream;

establishing a second signal representative of a desired minimum flow rate for said inlet stream;

comparing said first signal and said second signal and establishing a third signal responsive to the difference between said first signal and said second signal; and manipulating the flow rate of said recycle stream in response to said third signal.

10. A method in accordance with claim 9 wherein said recycle stream flows through a first control valve and wherein said step for manipulating the flow rate of said recycle stream in response to said third signal comprises the additional step of:

scaling said third signal to be representative of the position of said first control valve required to maintain said first signal substantially equal to said second signal.

11. A method in accordance with claim 10 wherein said step of cooling at least a portion of said sidestream to form a cool gas stream comprises;

passing said sidestream to said first branch (28, 30), which comprises a parallel conduit arrangement, wherein said sidestream is split so that a portion thereof flows through a cooler and the remaining portion thereof flows through a bypass conduit having a second control valve operatively located therein, and wherein said portions of said sidestream are recombined downstream of said cooler and said second control valve to form said cool gas stream.

establishing a fourth signal representative of the actual temperature of said recycle stream;

establishing a fifth signal representative of a desired minimum temperature for said recycle stream; and comparing said fourth signal and said fifth signal and establishing a sixth signal which is responsive to the difference between said fourth signal and said fifth signal, and scaling said sixth signal so as to be representative of the position of said second control valve required to maintain the actual temperature of said recycle stream, represented by said fourth signal, substantially equal to the desired temperature for said recycle stream represented by said fifth signal.

12. A method in accordance with claim 8 wherein said mainstream flows through a third control valve and wherein said step of manipulating the flow rate of the division of compressed gas stream to maintain a desired temperature for said discharge stream comprises:

establishing a first signal which is representative of the actual temperature of said discharge stream;

establishing a second signal which is representative of the desired temperature for said discharge stream;

comparing said first signal and said second signal and establishing a third signal which is responsive to the difference between said first signal and said second signal, and scaling said third signal so as to be representative of the position of said third control valve required to maintain the actual temperature of said compressed gas stream substantially equal to said second signal;

manipulating said third control valve in response to said third signal.

13. A method in accordance with claim 12 wherein said step of manipulating the division of said compressed gas stream additionally comprises the following steps:

establishing a fourth signal representative of the actual differential pressure across said cooler;

establishing a fifth signal representative of the desired maximum differential pressure across said cooler;

comparing said fourth signal and said fifth signal and establishing a sixth signal which is responsive to the difference between said fourth signal and said fifth signal and scaling said sixth signal so as to be representative of the position of said third control valve required to maintain the actual differential pressure across said cooler represented by said fourth signal substantially equal to the desired minimum differential pressure across said cooler represented by said fifth signal;

selecting the one of said third signal and said sixth signal which is representative of the greater opening of said third control valve to be established as a seventh signal; and establishing an eighth signal which is representative of the actual differential pressure across said compressor;

establishing a ninth signal which is representative of the desired minimum differential pressure across said compressor;

comparing said eighth signal and said ninth signal and establishing a tenth signal which is responsive to the difference between said eighth signal and said ninth signal and scaling said tenth signal so as to be representative of the position of said third control valve required to maintain the actual differential pressure across said compressor represented by said eighth signal substantially equal to the desired minimum differential pressure across said compressor represented by said ninth signal;

selecting the one of said seventh signal and said tenth signal which represents the lesser opening of said third control valve for establishing an eleventh signal; and manipulating said third control valve in response to said eleventh signal.

* * * * *